US011840103B2

(12) United States Patent
Smith

(10) Patent No.: US 11,840,103 B2
(45) Date of Patent: Dec. 12, 2023

(54) TAPELESS CARRIER FOR MECHANICALLY FIXING TUBE-SHAPED OBJECTS

(71) Applicant: Tyco Electronics UK Ltd, Swindon (GB)

(72) Inventor: Lee Smith, Swindon (GB)

(73) Assignee: Tyco Electronics UK Ltd., Swindon (GB)

( * ) Notice: Subject to any disclaimer, the term of this patent is extended or adjusted under 35 U.S.C. 154(b) by 46 days.

(21) Appl. No.: 17/503,843

(22) Filed: Oct. 18, 2021

(65) Prior Publication Data

US 2022/0032654 A1 Feb. 3, 2022

Related U.S. Application Data

(63) Continuation of application No. PCT/EP2020/060564, filed on Apr. 15, 2020.

(30) Foreign Application Priority Data

Apr. 18, 2019 (EP) ..... 19170002

(51) Int. Cl.
*B41J 3/407* (2006.01)
*B41J 11/26* (2006.01)

(52) U.S. Cl.
CPC ..... *B41J 3/40733* (2020.08); *B41J 3/4073* (2013.01); *B41J 11/26* (2013.01)

(58) Field of Classification Search
CPC ..... B41J 3/40733; B41J 3/4073; B41J 11/26
See application file for complete search history.

(56) References Cited

U.S. PATENT DOCUMENTS

| | | | | |
|---|---|---|---|---|
| 3,985,852 | A | 10/1976 | Evans | |
| 4,032,010 | A * | 6/1977 | Evans | G09F 3/0295 206/390 |
| 4,865,895 | A | 9/1989 | Vlamings et al. | |
| 5,862,751 | A | 1/1999 | Triantopoulos et al. | |
| 2008/0000572 | A1 | 1/2008 | Lopez | |
| 2010/0289202 | A1 | 11/2010 | Cordes | |

FOREIGN PATENT DOCUMENTS

| | | | |
|---|---|---|---|
| CA | 1262045 | A | 10/1989 |
| CA | 1293476 | C | 12/1991 |
| EP | 0456757 | B1 | 7/1996 |
| EP | 2235714 | B1 | 8/2016 |
| WO | 9714129 | A1 | 4/1997 |

OTHER PUBLICATIONS

PCT Search Report, dated Jun. 19, 2020, 16 pages.

* cited by examiner

*Primary Examiner* — Henok D Legesse
(74) *Attorney, Agent, or Firm* — Barley Snyder

(57) ABSTRACT

A carrier includes a body and a prong formed as a unilaterally fixed arm connected to the body at an end. The prong is folded in a longitudinal direction and has a kink. The prong is insertable into a tube shaped object and mechanically fixes the tube shaped object.

19 Claims, 4 Drawing Sheets

TAPELESS CARRIER FOR MECHANICALLY FIXING TUBE-SHAPED OBJECTS

CROSS-REFERENCE TO RELATED APPLICATIONS

This application is a continuation of PCT International Application No. PCT/EP2020/060564, filed on Apr. 15, 2020, which claims priority under 35 U.S.C. § 119 to European Patent Application No. 19170002.0, filed on Apr. 18, 2019.

FIELD OF THE INVENTION

The present invention relates to a carrier and, more particularly, to a carrier for fixing tube shaped objects.

BACKGROUND

Heat shrink tubes are used to mark electrical cables. For this purpose, the shrink sleeves are labeled before they are placed on the cable and heat shrunk. In case of higher numbers of shrink sleeves, the labeling is done by printers. To print the shrink tubing in the printers precisely, it is common to arrange them on shrink tube holders.

Simple shrink tube carriers are known, for example, from U.S. Pat. No. 3,985,852. This patent discloses carriers with prongs to position the tubing thereon. The disadvantage of this approach is that the position of the shrink tubings on the prongs is not always precisely defined, which can affect the quality of the printed image. Similar carriers are suggested e.g. by Canadian Patents CA 1,293,476 and CA 1,262,045. Here, a holder comprises two prongs which improve the stability for the shrink sleeves. However, detaching the shrink tubing from the two halves of the shrink tube holder can be tedious.

Furthermore, European Patent No. EP 2 235 714 B1 discloses a shrink tube carrier which is able to be inserted into printers, with which the held heat shrink tubes are able to be printed. Moreover, United States Patent Application Publication No. 2008/0000572 A1 provides a method and kit for labeling an object having a generally rounded outer surface.

Finally, U.S. Pat. No. 5,862,751 discloses an apparatus for use in providing printed wire markers, comprising a spool of unprinted wire markers, a casing for the spool, the casing bearing sensible indicia defining information related to the encased wire markers, a sensor for sensing the indicia and providing output signals indicative of the information, and a wire marker printer for receiving the spooled, unprinted wire markers from the casing and printing the information thereon accordingly.

The shrink tube holders described above, however, only comprise flat prongs for holding the shrink tubes. This is a disadvantage, since a flat prong is prone to deformation.

SUMMARY

A carrier includes a body and a prong formed as a unilaterally fixed arm connected to the body at an end. The prong is folded in a longitudinal direction and has a kink. The prong is insertable into a tube shaped object and mechanically fixes the tube shaped object.

BRIEF DESCRIPTION OF THE DRAWINGS

The invention will now be described by way of example with reference to the accompanying Figures, of which.

DETAILED DESCRIPTION OF THE EMBODIMENT(S)

The accompanying drawings are incorporated into the specification and form a part of the specification to illustrate several embodiments of the present invention. These drawings, together with the description, serve to explain the principles of the invention. The drawings are merely for the purpose of illustrating examples of how the invention can be made and used, and are not to be construed as limiting the invention to only the illustrated and described embodiments. Furthermore, several aspects of the embodiments may form—individually or in different combinations—solutions according to the present invention. The following described embodiments thus can be considered either alone or in an arbitrary combination thereof. Further features and advantages will become apparent from the following more particular description of the various embodiments of the invention, as illustrated in the accompanying drawings, in which like references refer to like elements.

The present invention will now be explained in more detail with reference to the Figures. In particular, embodiments of the present invention are described. The embodiments are examples of how the present invention can be used and do not limit the present invention.

Figure 2:
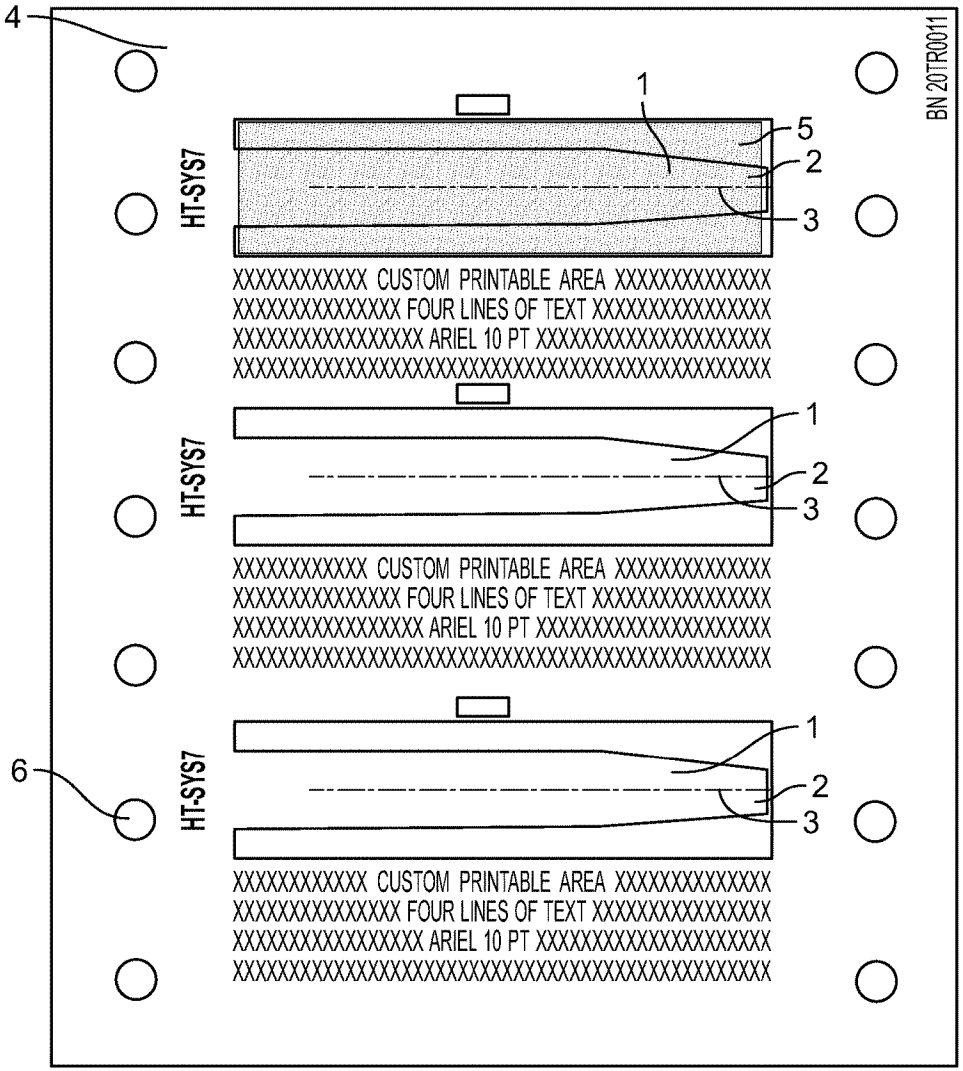
FIG. 2 is a side view of the carrier.
Figure 1:
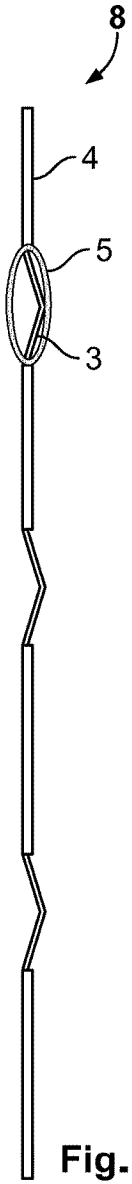
FIG. 1 is a plan view of a carrier according to an embodiment.

FIGS. 1 and 2 show a carrier 8 according to an embodiment for mechanically fixing at least one tube shaped object 5. In the shown embodiment, the carrier 8 comprises a body 4 and several prongs 1 spaced equally along the carrier 1. A first side of the prongs 1 is connected to the body 4, and an opposite second side of the prongs 1 is a free end not connected to the body 4, thereby allowing the tube shaped object 5 to be easily removed from the prong 1; each of the prongs 1 is a single, unilaterally fixed arm.

The prongs 1 comprise tapering 2 on the non-connected side and a kink 3 along their longitudinal axis. The prongs 1 are each folded along the longitudinal direction to form the kink 3; as compared to a flat prong, a folded prong 1 with a kink 3 is much more robust against deforming.

The carrier 8 design allows for positioning and fixing of tube shaped objects 5 without the need for adhesive tape, thereby reducing the amount of non-recyclable material, decreasing the wear of thermal print heads, and increasing the printable area of the tube shaped objects 5. The prongs 1 are constructed robustly, such that the carrier 8 is not prone to be deformed. The design of the prong 1 as a single, unilaterally fixed arm allows for easily removing the tube shaped object 5, as compared to a design with two arms where each arm is fixed on one side.

In the embodiment shown in FIGS. 1 and 2, the carrier 8, including the body 4 and the prong 1, is produced from a single piece of sheet and does not contain any materials which are not recyclable. This makes the carrier 8 environmentally beneficial as compared to other carrier designs using tapes.

In an embodiment, the at least one prong 1 may comprise a material that is thinner than the material which makes up the body 4 of the carrier 8. Therefore, there is no step between the tube shaped objects 5 to be imprinted and the rest of the carrier 8. This makes the imprinting of the tube shaped objects 5 even easier.

In the embodiment shown in FIGS. 1 and 2, the tube shaped objects 5 are heat shrink tubes. The prongs 1 of the carrier 8 are inserted into the heat shrink tubes, and thereby the heat shrink tubes are fixed in place. The at least one prong 1 may be tapered 2 towards a free standing end, which simplifies inserting the prong 1 into the tube shaped object 5.

Figure 3:
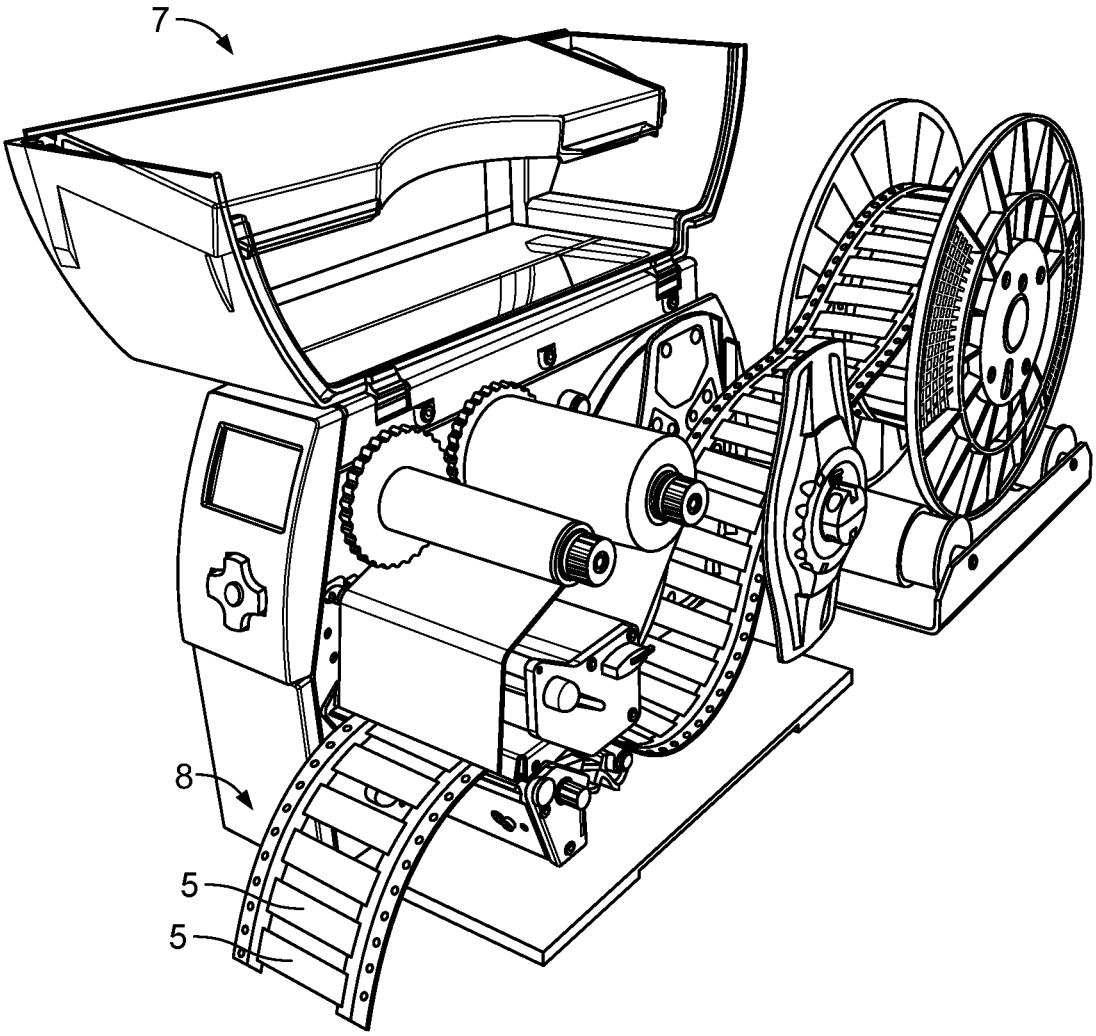
FIG. 3 is a perspective view of a printer with the carrier.

FIG. 3 shows in a perspective view the application of the carrier 8 in a printer 7. An assembly according to an embodiment includes the carrier 8, the printer 7, and the tube shaped object 5. The carrier 8 fixes several tube shaped objects 5, for example heat shrink tubes, which are to be provided with an imprint. The carrier 8 is inserted into the printer 7 such that the heat shrink tubes are moved alongside a print head of the printer 7, where they can be imprinted.

The carrier 8 has regularly spaced engagement holes 6, shown in FIG. 2, for moving the carrier 8 through a printer 7. Therefore, the carrier 8 allows for easily imprinting a high number of tube shaped objects 5 automatically with the printer 7.

Figure 4:
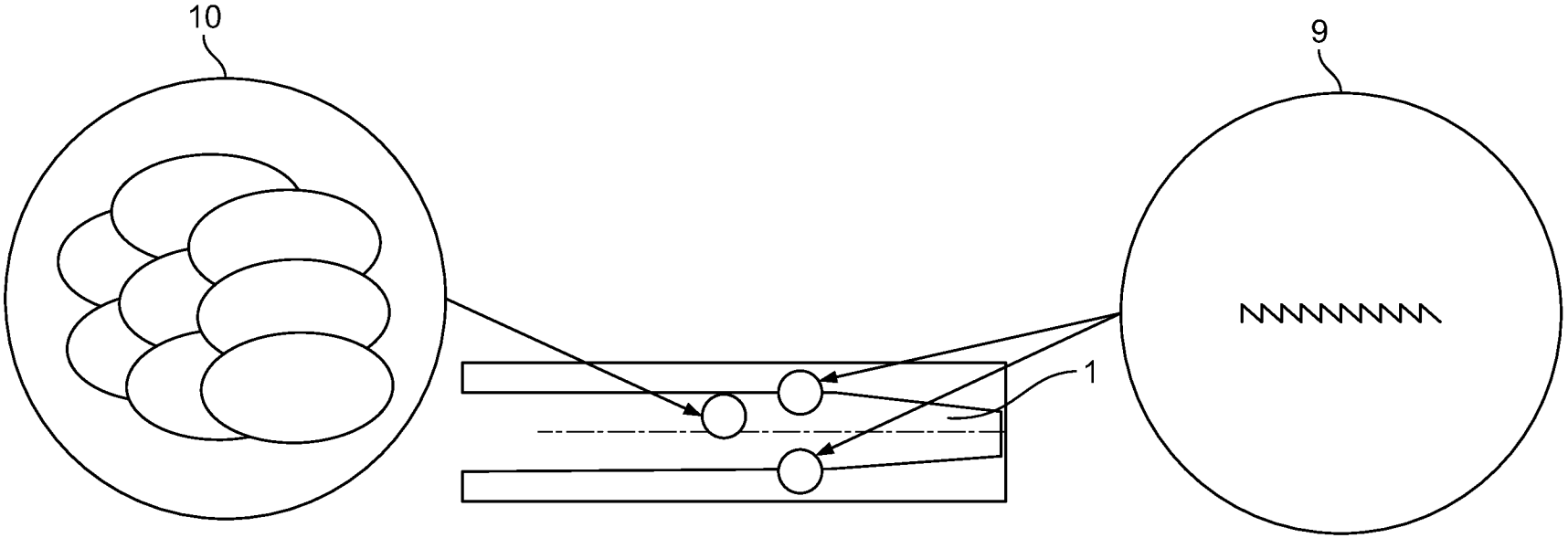
FIG. 4 is a plan view of a prong of the carrier according to an embodiment.

FIG. 4 shows an exemplary detail of a prong 1. It shows a single prong 1 which comprises serrations 9, also referred to as shark fin cuts, on its edges and a scale embossing 10 on its surface. The serrations 9 and the scale embossing 10, also referred to as a fish scale embossing, prevent the tube shaped objects 5 from moving when affixed on the prong 1. Of course, these features can also be used separately from each other.

Figure 5:
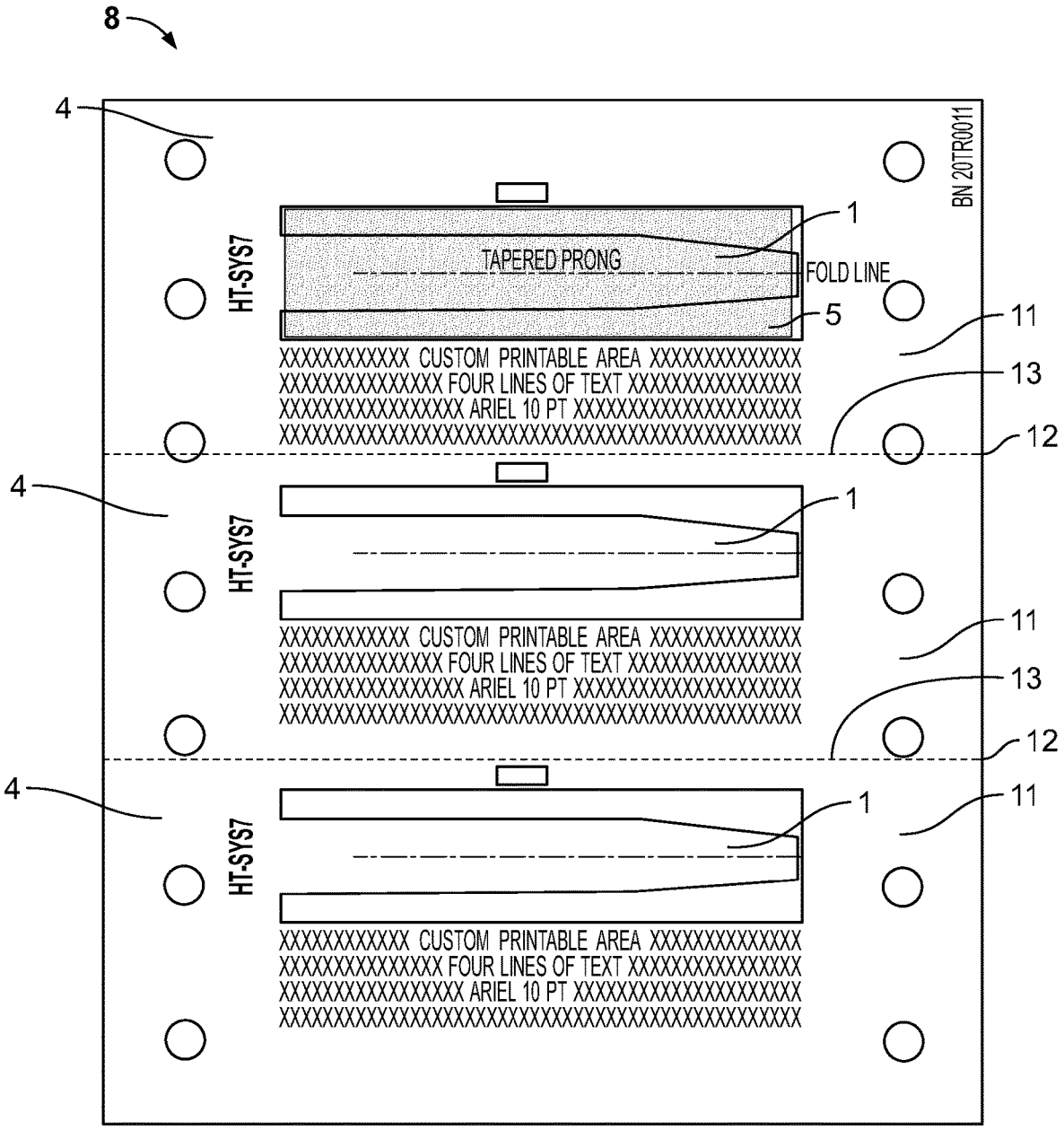
FIG. 5 is a side view of a carrier according to another embodiment.

FIG. 5 shows a carrier 8 according to a further advantageous embodiment with prongs 1 for mechanically fixing at least one tube shaped object 5. The carrier 8 is divided into holding regions 11, where each holding regions 11 comprises exactly one prong 1 and a part of the body 4, which is surrounding the respective prong 1. The holding regions 11 in the embodiment shown in FIG. 5 are separated by separation joints 12. The separation joints 12 are placed between two prongs 1 on the part of the body 4, which surrounds the prongs 1. Moreover, the separation joints 12 comprise perforations 13 allowing for tearing away the holding regions 11 from the carrier 8.

What is claimed is:

1. A carrier, comprising:

a body; and a prong formed as a unilaterally fixed arm connected to the body at an end, the prong is folded in a longitudinal direction and has a kink, the prong has a thickness that is less than a thickness of the body.

2. The carrier of claim 1, wherein the body and the prong are produced from a single sheet.

3. The carrier of claim 1, wherein the prong is one of a plurality of prongs spaced equally along the carrier.

4. The carrier of claim 3, further comprising a plurality of separation joints extending across the carrier and separating a plurality of holding regions.

5. The carrier of claim 4, wherein each of the prongs is disposed in one of the holding regions.

6. The carrier of claim 4, wherein each of the separation joints has a plurality of perforations.

7. The carrier of claim 1, wherein the prong is tapered toward a free standing end.

8. The carrier of claim 1, wherein the prong has an edge with a plurality of serrations.

9. The carrier of claim 1, wherein a surface of the prong has a scale embossing.

10. The carrier of claim 1, wherein the prong is insertable into a tube shaped object to mechanically fix the tube shaped object.

11. The carrier of claim 10, wherein the carrier is insertable into a printer with which the tube shaped object can be imprinted.

12. The carrier of claim 11, further comprising a plurality of regularly spaced engagement holes for moving the carrier through the printer.

13. An assembly, comprising:

a carrier including a body and a prong formed as a unilaterally fixed arm connected to the body at an end, the prong is folded in a longitudinal direction and has a kink, the prong has a thickness that is less than a thickness of the body; and a tube shaped object, the prong is insertable into the tube shaped object and mechanically fixes the tube shaped object.

14. The assembly of claim 13, further comprising a printer moving the carrier mechanically fixing the tube shaped object along a print head and imprinting the tube shaped object.

15. A method for mechanically fixing a tube shaped object, comprising:

providing a carrier including a body and a prong formed as a unilaterally fixed arm connected to the body at an end, the prong is folded in a longitudinal direction and has a kink the prong has a thickness that is less than a thickness of the body; and sliding the tube shaped object over the prong along the longitudinal direction.

16. The method of claim 15, further comprising forming the prong to support a full length of the tube shaped object.

17. The method of claim 15, wherein, when the tube shaped object is disposed on the prong, a surface of the tube shaped object is flush with a surface of the body.

18. The method of claim 15, further comprising providing a printer and inserting the carrier into the printer.

19. The method of claim 18, further comprising imprinting the tube shaped object with the printer while the tube shaped object is on the carrier.

* * * * *